US006695575B1

(12) United States Patent
Sasse et al.

(10) Patent No.: US 6,695,575 B1
(45) Date of Patent: Feb. 24, 2004

(54) TURBINE METHOD FOR DISCHARGING LEAKAGE FLUID

(75) Inventors: Stefan Sasse, Duisburg (DE); Rainer Tamme, Essen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/069,543

(22) PCT Filed: Aug. 18, 2000

(86) PCT No.: PCT/EP00/08089

§ 371 (c)(1),
(2), (4) Date: Feb. 27, 2002

(87) PCT Pub. No.: WO01/16467

PCT Pub. Date: Mar. 8, 2001

(30) Foreign Application Priority Data

Aug. 27, 1999 (EP) ..... 99116939

(51) Int. Cl.[7] ..... F01D 3/00
(52) U.S. Cl. ..... 415/107; 415/116; 417/405
(58) Field of Search ..... 415/107, 116, 415/112, 110, 111, 109, 175; 417/405, 360, 379, 409; 29/889.1, 889.12

(56) References Cited

U.S. PATENT DOCUMENTS

| | | | | | |
|---|---|---|---|---|---|
| 3,647,311 | A | * | 3/1972 | Wootton et al. | 415/113 |
| 3,754,833 | A | | 8/1973 | Remberg | |
| 4,276,002 | A | * | 6/1981 | Anderson | 417/405 |
| 4,439,107 | A | * | 3/1984 | Antonellis | 416/95 |
| 4,663,938 | A | * | 5/1987 | Colgate | 60/620 |
| 4,916,892 | A | * | 4/1990 | Pope | 60/39.02 |
| 5,224,713 | A | | 7/1993 | Pope | |
| 5,517,817 | A | * | 5/1996 | Hines | 60/39.75 |
| 5,564,896 | A | * | 10/1996 | Beeck et al. | 415/175 |
| 6,392,313 | B1 | * | 5/2002 | Epstein et al. | 290/52 |

FOREIGN PATENT DOCUMENTS

| | | |
|---|---|---|
| DE | 281253 | 2/1912 |
| DE | 467 562 | 10/1928 |
| DE | 6809708 | 12/1968 |
| DE | 34 24 138 A1 | 1/1986 |
| DE | 19701020 | 7/1998 |
| FR | 1.001.387 | 2/1952 |
| FR | 1.360.000 | 3/1964 |

* cited by examiner

*Primary Examiner*—Edward K. Look
*Assistant Examiner*—J. M. McAleenan
(74) *Attorney, Agent, or Firm*—Harness, Dickey & Pierce, P.L.C.

(57) ABSTRACT

The invention relates to a turbine (1) having a rotor (2), which has a bladed area (3) for rotor blades (4) and a thrust compensation piston (5). The thrust compensation piston (5) has a hot side (6), which faces the bladed area (3), and a cold side (7), which is remote from the bladed area (3). On one side, a feed (14) for sealing fluid (15), which is assigned to the cold side (7), and a leakage fluid feed (12), which is flow-connected to the bladed area (3), open out into a mixing area (13), and on the other side a discharge line (16) branches off from the mixing area. The invention also relates to a method for discharging hot leakage fluid (17). In a turbine (1), the leakage fluid (17) passes through a radial gap (12) between a thrust compensation piston (5) of a rotor (2) and a stationary turbine part (11) and is mixed with a cooler sealing fluid (15) and discharged.

20 Claims, 3 Drawing Sheets

TURBINE METHOD FOR DISCHARGING LEAKAGE FLUID

This application is the national phase under 35 U.S.C. §371 of PCT International Application No. PCT/EP00/08089 which has an International filing date of Aug. 18, 2000, which designated the United States of America, the entire contents of which are hereby incorporated by reference.

FIELD OF THE INVENTION

The invention generally relates to a turbine. In particular, it can relate to a steam turbine with a rotor, which has a bladed area for rotor blades and a thrust compensation piston. The thrust compensation piston may have a hot side, which faces the bladed area, and a cold side, which is remote from the bladed area. The invention also generally relates to a method for discharging leakage fluid which flows over the thrust compensation piston.

BACKGROUND OF THE INVENTION

German utility model 6809708 dated Dec. 12, 1968 has described a multishell axial, throttle-controlled steam turbine for high pressures and temperatures. The steam turbine in this case has an inner housing part and a guide-blade carrier, which are structurally combined to form a single inner shell which is split in the axial plane. The inner shell is surrounded by an outer housing, which is designed in the form of a pot. For its part, the inner shell surrounds a turbine shaft, also known as the rotor, which has a bladed area with rotor blades. Shaft seals between rotor and outer housing are provided at each of the opposite ends of the rotor. At one end of the rotor, the steam flowing through the steam turbine enters the bladed area and causes the rotor to rotate about its axis of rotation. At the opposite end, the steam, which is now at least partly expanded, escapes from the bladed area and the steam turbine. In the process, the steam exerts a thrust on the rotor. To counteract this thrust, the rotor has a compensation piston arrangement at the end at which the steam flows in. This arrangement is distinguished by an end face which faces the bladed area and has a larger surface area than an end face which is remote from the bladed area. A similar steam turbine of pot design is described in U.S. Pat. No. 3,754,833.

German Patent 281 253 has described a device for relieving the load on a ship's turbine. The turbine has a forward and a reverse turbine with constant-pressure and excess-pressure sets, which are accommodated in a single housing and are relieved by a drum wall. To relieve the load on the turbine, a divided load-relief surface is provided between the forward turbine and a shaft bearing. This makes it possible to relieve the blade thrust and the thrust of the ship's propeller both in forward and reverse mode.

DE 197 01 020 has described a steam turbine having a high-pressure part turbine and a medium-pressure part turbine with a degree of reaction which varies across the turbine stages. The medium-pressure and high-pressure part turbines may in this case be accommodated in a single housing, in which case each of the part turbines is of single-flow design. A thrust compensation piston is provided for the purpose of absorbing axial thrust of a medium-pressure part turbine which is of drum design. This pressure compensation piston is arranged between a shaft bearing and the high-pressure part turbine. On the side assigned to the shaft bearing, the thrust compensation piston is acted on by steam from the exhaust-steam area of the medium-pressure part turbine, and on the side assigned to the high-pressure part turbine, the thrust compensation piston is acted on by steam from the exhaust-steam area of the high-pressure part turbine. The part turbines may also be accommodated in two separate housings. In the case of a single-flow design, a thrust compensation piston is then likewise provided.

SUMMARY OF THE INVENTION

It is an object of an embodiment of the invention to provide a turbine having a thrust compensation arrangement for high temperat ures of a working medium which drives the turbine. A further object of an embodiment of the invention is to provi de a method for discharging leakage steam in a thrust compensation arrangement.

According to the invention, an object relating to a turbine may be achieved by a turbine having a rotor which has a bladed area for rotor blades and a thrust compensation piston. The thrust compensation piston may have a hot side, which faces the bladed area, and a cold side which is remote from the bladed area. Further, a mixing area may be included, into which a feed for sealing fluid, which is assigned to the cold side, and a leakage fluid feed, which is flow-connected to the bladed area, open out and from which a discharge line branches off.

In this context, the term thrust compensation piston is understood as meaning a thrust compensation arrangement which is mechanically connected to the rotor of the turbine, for example is produced integrally therewith, in particular by forging or casting, or is welded or screwed thereto or otherwise fixedly connected thereto in some other mechanical way. In particular, the thrust compensation piston includes sur faces which can be acted on by a medium, such as steam or gas, so that overall a force which is directed oppositely to the thrust which the wo rking medium imparts to the rotor in the direction of its axis of rotation is generated on the thrust compensation piston.

A flow connection between two parts or two areas refers to a fluid can flow from one area (part) to the other. A flow connection is produced, for example, by a fluid line, an opening or the like.

In this connection, an embodiment of the invention may be based on the consideration that the thrust compensation piston, referred to below as the piston for short, comes into contact with working medium. This working medium can flow through between the piston and a stationary turbine part, for example an inner housing. This results in a leakage flow of the working medium. Although this leakage flow can be reduced by seals, complete sealing is impossible to achieve by contact-free seals. The leakage flow may be at high temperatures, up to 600° C. in the case of steam turbines and even higher in the case of gas turbines. Therefore, the hot leakage steam flow can impinge on turbine parts which are not designed for such high temperatures. To avoid this, it would be necessary for even turbine parts which lie outside the flow area of the hot working medium to be made from materials which are suitable for such high temperatures, which materials are often expensive and relatively difficult to machine.

As an alternative, it would also be possible for a further sealing area to be arranged at the flow region of the end of the piston which is remote from the hot working medium, also referred to below as the cold side. In addition or as an alternative, a suction device could be provided for sucking out the leakage flow. In this case, the leakage flow over the piston would be inversely proportional to the flow resistances of the additional sealing area and of the suction pipe included in the suction device. Complete sealing, preventing hot leaking fluid from impinging on turbine components which lie outside the flow area of the working medium, however, cannot be achieved in this way.

According to an embodiment of the invention, the hot leakage fluid can be mixed with a cooler sealing fluid, so that after the two fluids have been mixed a fluid mixture is present. The fluid mixture can then escape from the mixing area via the discharge. This enables the fluid mixture, which is at a lower temperature than the leakage fluid, to be discharged in a controlled manner into appropriate turbine areas. Therefore, the piston is completely sealed with regard to the leakage fluid. In this way, a leakage flow outside the piston, e.g. along the rotor, is reliably avoided. The temperature of the fluid mixture is preferably below the permissible temperature of use of turbine parts outside the area of flow of the hot working medium.

The mixing area is preferably arranged on the cold side of the piston. As a result, a sealing area with, for example, a contact-free seal can be provided between the hot side of the piston and the mixing area in the leakage-fluid feed.

It is preferable for a delivery device for generating a flow of sealing fluid which is directed radially outward to be provided on the cold side of the piston, in which case the delivery device is flow-connected to the feed for sealing fluid. In particular, the delivery device has a plurality of flow-guiding elements, such as radial grooves, radial bores, guide plates or similarly acting shapes and geometries. A delivery device of this type forms a radial fan.

The delivery device in particular may convey the sealing fluid toward the mixing area simply as a result of the rotation of the rotor. As a result, the sealing fluid passes into the mixing area without requiring further additional devices. A flow of the sealing fluid which is generated by the delivery device is therefore preferably directed oppositely to the flow of the leakage fluid.

It is preferable for the delivery device to be produced integrally with the thrust compensation piston. In particular, the flow-guiding elements are welded to the cold side of the piston or secured there in a similar way.

The turbine is preferably a steam turbine, in particular a medium-pressure part turbine. It is also preferable for the turbine to be of single-flow design.

The turbine preferably has an outer housing, in which an inner housing is arranged. The inner housing surrounds the rotor, the leakage fluid feed being formed, with a radial gap, between the thrust compensation piston and the inner housing. It is preferable for a contact-free seal to be arranged in a gap of this type.

An object relating to a method can be achieved, according to an embodiment of the invention, by a method for discharging hot leakage fluid. The leakage fluid, in a turbine, may flow through a radial gap between a thrust compensation piston of a rotor and a stationary turbine part, with the hot leakage fluid being mixed with a cooler sealing fluid and discharged. With regard to the advantages and operation of the method, reference is made to the statements given above in connection with the structural design of the turbine, for example.

Mixing the leakage fluid with the sealing fluid results in the formation of a fluid mixture, which is likewise at a cooler temperature than the leakage fluid. By suitably selecting the location at which the mixing takes place, it is possible to achieve complete sealing of the piston. In this case, the leakage fluid is preferably mixed with the sealing fluid at the thrust compensation piston, in particular on the cold side.

A flow of the sealing fluid is preferably generated by rotation of the rotor. This is achieved, in particular, via a delivery device arranged on the thrust compensation piston. The flow of the sealing fluid is preferably directed radially outward. The sealing fluid is conveyed radially outward by the delivery device.

The sealing fluid used is preferably steam if the leakage fluid is hot steam, in which case the sealing fluid is cooler steam. This is the case in particular in a steam turbine. In the case of a gas turbine, it is preferable for a gas, for example cooling air, to be used as the sealing fluid.

BRIEF DESCRIPTION OF THE DRAWINGS

The turbine and the method for discharging leakage fluid are explained by way of example with reference to the exemplary embodiments illustrated in the drawings, in which:

In FIGS. 1 to 3, identical reference symbols in each case have identical meanings.

DETAILED DESCRIPTION OF THE PREFERRED EMBODIMENTS

Figure 1:
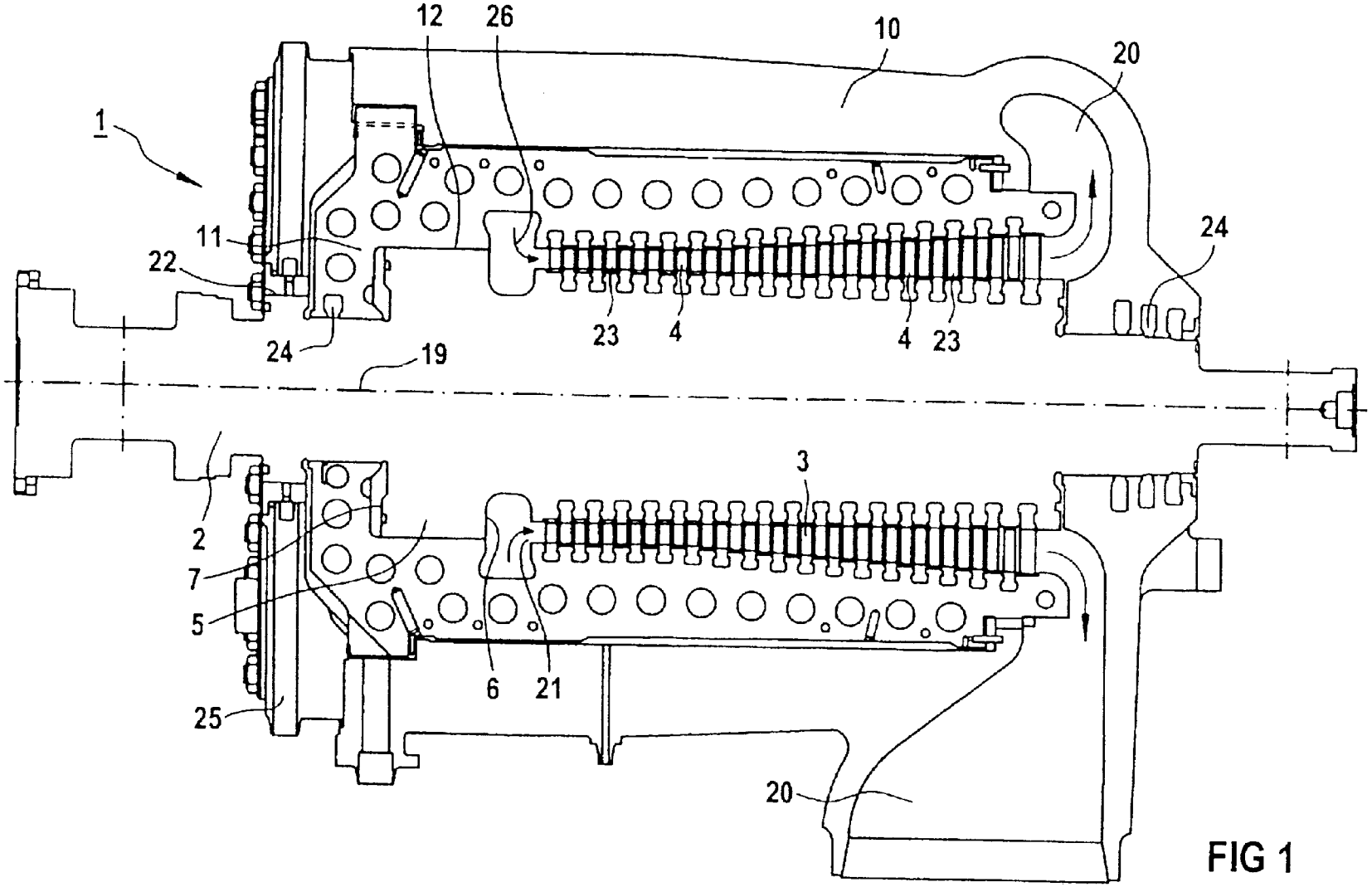
FIG. 1 shows a longitudinal section through a high-pressure steam turbine.

FIG. 1 shows a longitudinal section through a turbine 1 of one embodiment of the present invention, in this case a high-pressure steam turbine of pot structure. The turbine 1 has a rotor 2 which extends along an axis of rotation 19. The rotor 2 is surrounded by an inner housing 11, which in turn is surrounded by an outer housing 10. On both sides of the outer housing 10, the rotor 2 is mounted via a respective shaft bearing 22. At both end regions 25 of the outer housing 10 from which the rotor 2 projects, there is in each case one shaft seal 24. Between an inflow area 21 and an exhaust-steam area 20 for a hot action medium 26, in this case hot steam, the rotor 2 has a bladed area 3. In the bladed area 3, the rotor 2 has rotor blades 4 which are spaced apart from one another in the axial direction. In each case one row of guide blades 23 is arranged on the inner housing 11 between axially adjacent rotor blades 4.

The rotor 2 has a thrust compensation piston 5, the inflow area 21 being arranged. axially between the bladed area 3 and the thrust compensation piston 5. The thrust compensation piston 5, referred to below as the piston 5 for short, has a hot side 6 facing the inflow area 21 and a cold side 7 remote from the inflow area 21.

Figure 2:
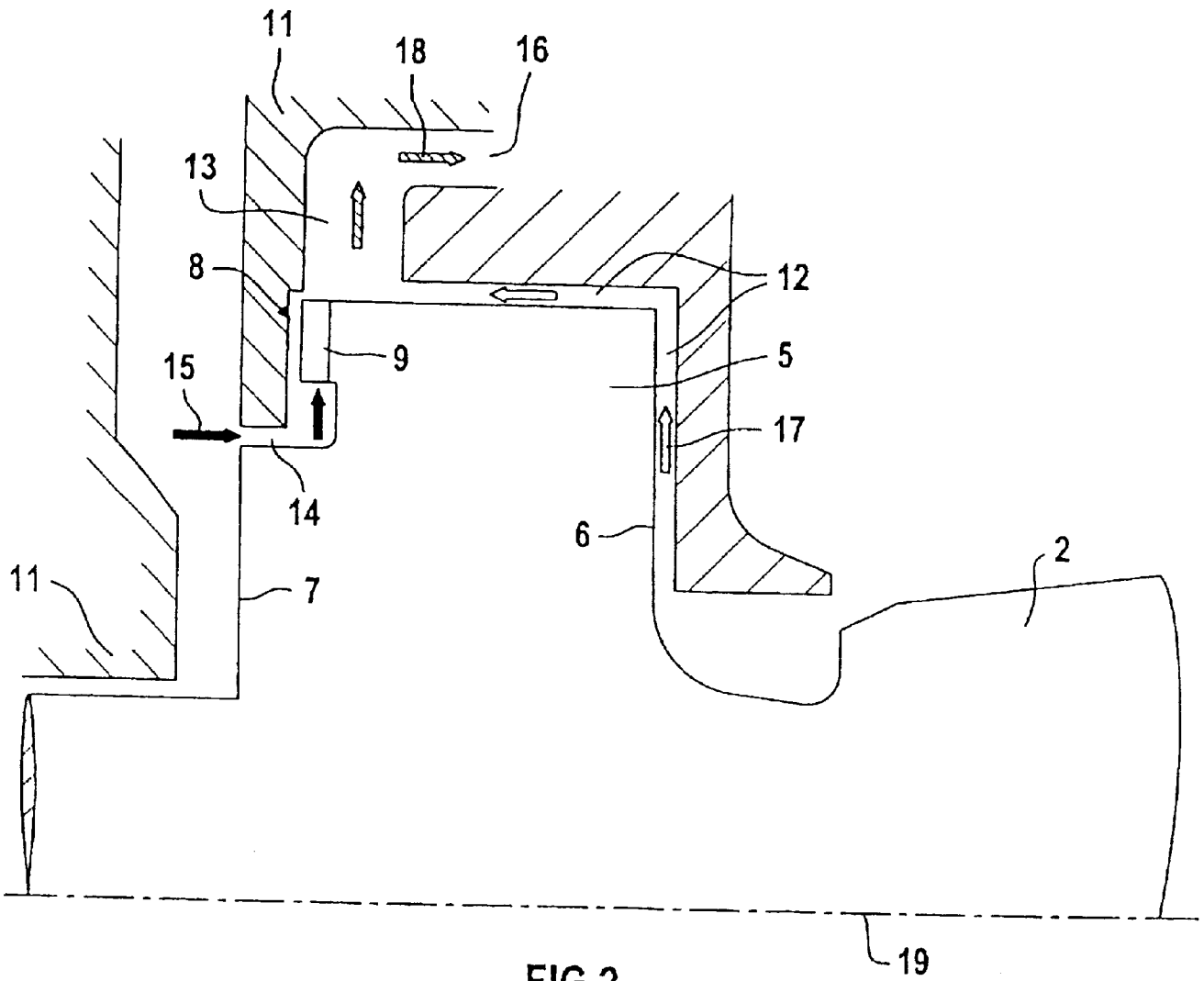
FIG. 2 shows part of a longitudinal section through a steam turbine in the region of a thrust compensation piston.

When the turbine 1 is operating, the action medium 26 flows into the inflow area 21, flows through the bladed area 3 and leaves the turbine 1 through the exhaust-steam area 20. As it flows through the bladed area 3, the action medium 26 exerts a force on the rotor blades 4 and therefore on the rotor 2. As a result, a thrust is generated in the direction of the axis of rotation 19. This thrust is counteracted by the thrust compensation piston 5. For this purpose, the piston 5 has surfaces of equal or different size (not shown in more detail) on the cold side 7 and the hot side 6, which surfaces are acted on by the same pressure or different pressures. The difference between the products of pressure and relevant surface area on the cold side 7 and on the hot side 6 results in an axial force which counteracts the thrust. While the turbine 1 is operating, part of the action fluid 26 flows over the piston 5 in the axial direction as leakage fluid 17 (c.f. FIG. 2), in particular when a pressure difference is prevailing between cold side 7 and hot side 6. The quantity of leakage fluid 17 is kept at a low level by a contact-free seal (not shown).

FIG. 2 shows part of a longitudinal section through a turbine 1, in particular a single-flow medium-pressure steam turbine of an embodiment of the invention. A rotor 2, which extends along an axis of rotation 19, has a thrust compensation piston 5. For explanation of the way in which this operates, reference is made to the statements given in connection with FIG. 1. The rotor 2 and therefore also the piston 5 is surrounded by an inner housing 11. The piston 5 has a hot side 6, which faces a bladed area 3 (not shown), and a cold side 7, which is remote from this bladed area. A leakage fluid feed 12 is formed between the inner housing 11 and the piston 5, assigned to the hot side 6. This leakage fluid feed, at least in certain areas, forms a radial gap between the piston 5 and the inner housing 11. On the cold side 7, a feed 14 for sealing fluid 15 is provided. A mixing area 13, a chamber or the like, is provided at the end of the piston 5 which faces the cold side 7. Both the leakage fluid feed 12 and the feed 14 for the sealing fluid 15 open out into the mixing area 13. A discharge 16 leads from the mixing area 13 into the inner housing 11. On the cold side 7, a delivery device 8 having a plurality of flow-guiding elements 9 (cf. FIG. 3) is arranged at the piston 5.

When the rotor 2 rotates, this delivery device 8 acts as a radial fan. As a result, flow of the sealing fluid 15 into the mixing area 13 is achieved without the need for further additional devices. As a result, hot leakage fluid 17, hot steam, is mixed with the cooler sealing fluid 15, cooler steam, in the mixing area. The fluid mixture 18, including leakage fluid 17 and sealing fluid 15, which flows out of the mixing area 13 via the discharge line 16 is therefore at a lower temperature than the leakage fluid 17. This has two effects: firstly, no hot leakage fluid 17 escapes via the piston 5, since the sealing fluid 15 is flowing in the opposite direction to the leakage fluid 17. Secondly, a fluid mixture 18 which is at a lower temperature than the leakage fluid 17 enters the inner housing 11. Consequently, the turbine parts which come into contact with the fluid mixture 18 are not subjected to such high thermal loads as the turbine parts which come into contact with the working medium 26. Therefore, materials which have a lower ability to withstand thermal loads, i.e. less expensive materials, which are in some cases easier to process, can be used without danger for the turbine parts which come into contact with the fluid mixture 18.

Figure 3:
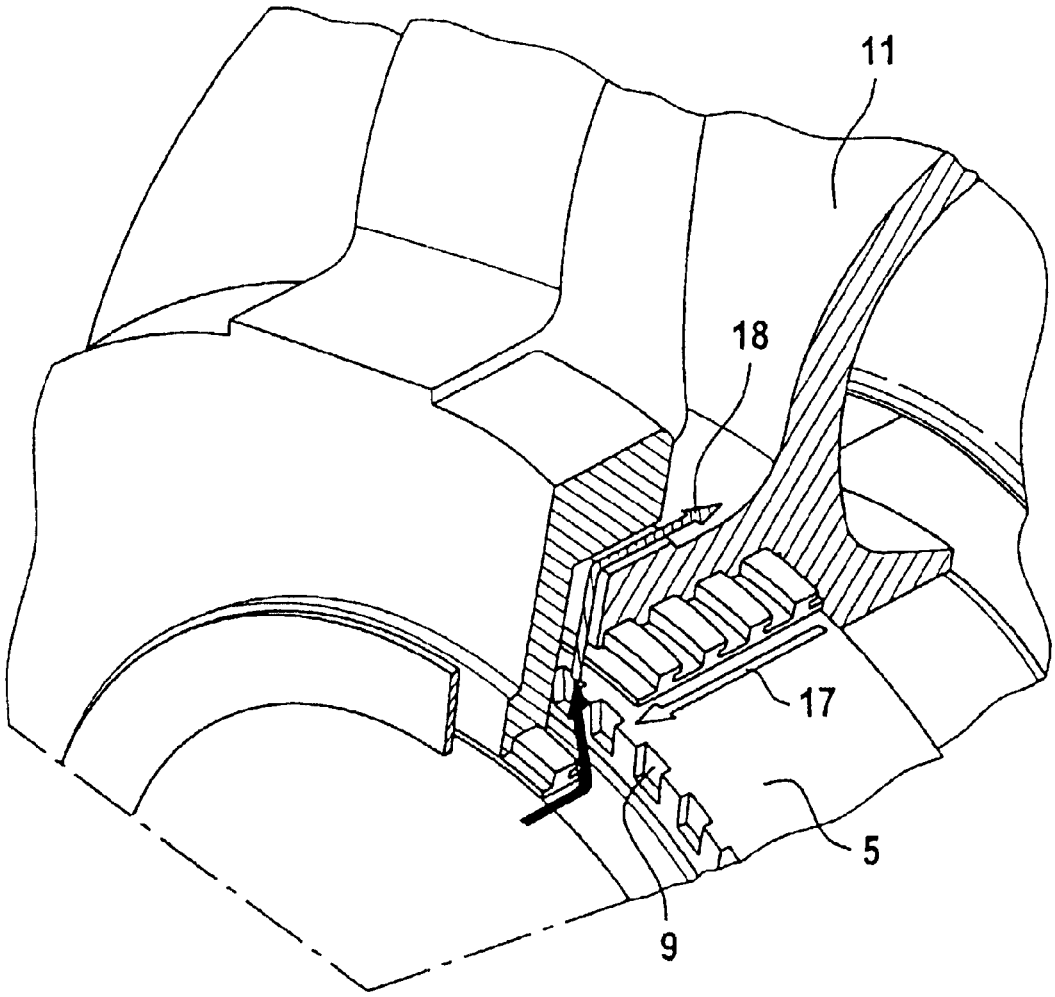
FIG. 3 shows a three-dimensional exert in the region of a thrust compensation piston.

FIG. 3 shows a perspective view through a turbine 1 shown in FIG. 2 in the region of the piston 5. Radial recesses, which form the flow elements 9 of the delivery device 8, are formed on the cold side 7.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A turbine, comprising:

a rotor including a bladed area for rotor blades and a thrust compensation piston, wherein the thrust compensation piston includes a hot side facing the bladed area and a cold side remote from the bladed area; and a mixing area, into which a feed for sealing fluid, assigned to the cold side, and a leakage fluid feed, flow-connected to the bladed area, open out, and from which a discharge line branches off, wherein said sealing fluid and leakage fluid is steam.

2. The turbine as claimed in claim 1, further comprising:

a delivery device, for generating a flow of sealing fluid directed radially outward, provided on the cold side, the delivery device being flow-connected to the feed for sealing fluid.

3. The turbine of claim 2, wherein the delivery device includes a plurality of flow guiding elements.

4. The turbine of claim 3, wherein the flow guiding elements include at least one of radial grooves, radial bores, and guide plates.

5. The turbine of claim 2, wherein the delivery device is produced integral with the thrust compensation piston.

6. The turbine as claimed in claim 2, further comprising:

an outer housing in which an inner housing is arranged, the inner housing surrounding the rotor, wherein the leakage fluid feed is formed, with a radial gap, between the thrust compensation piston and the inner housing.

7. The turbine as claimed in claim 1, further comprising:

a delivery device including a plurality of flow-guiding elements.

8. The turbine of claim 7, wherein the flow guiding elements include at least one of radial grooves, radial bores, and guide plates.

9. The turbine as claimed in claim 1, further comprising:

a delivery device, produced integrally with the thrust compensation piston.

10. The turbine as claimed in claim 1, further comprising:

an outer housing in which an inner housing is arranged, the inner housing surrounding the rotor, wherein the leakage fluid feed is formed, with a radial gap, between the thrust compensation piston and the inner housing.

11. The turbine as claimed in claim 1, wherein the turbine is of a single-flow design.

12. A turbine, comprising:

a rotor including a bladed area for rotor blades and a thrust compensation piston, wherein the thrust compensation piston includes a hot side facing the bladed area and a cold side remote from the bladed area; and a mixing area, into which a feed for sealing fluid, assigned to the cold side, and a leakage fluid feed, flow-connected to the bladed area, open out, and from which a discharge line branches off, wherein the turbine is a steam turbine.

13. The turbine of claim 12, wherein the steam turbine is a medium-pressure part turbine.

14. A method for discharging hot leakage fluid in a turbine, which leakage fluid flows through a radial gap between a thrust compensation piston of a rotor and a stationary turbine part, comprising:

mixing the hot leakage fluid with a cooler sealing fluid; and discharging the mixed fluid, wherein said sealing fluid and leakage fluid is steam.

15. The method as claimed in claim 14, wherein the leakage fluid is mixed with the sealing fluid at the thrust compensation piston.

16. The method as claimed in claim 15, wherein the sealing fluid is conveyed radially outward by a rotation of the rotor, via a delivery device arranged on the thrust compensation piston.

17. The method as claimed in claim 14, wherein the sealing fluid is conveyed radially outward by a rotation of the rotor, via a delivery device arranged on the thrust compensation piston.

18. A method for discharging hot leakage fluid in a turbine, which leakage fluid flows through a radial gap between a thrust compensation piston of a rotor and a stationary turbine part, comprising:

mixing the hot leakage fluid with a cooler sealing fluid; and discharging the mixed fluid, wherein the leakage fluid is relatively hot steam and the sealing fluid is relatively cooler steam.

19. A method for discharging hot leakage fluid in a turbine, which leakage fluid flows through a radial gap between a thrust compensation piston of a rotor and a stationary turbine part, comprising:

mixing the hot leakage fluid with a cooler sealing fluid; and discharging the mixed fluid, wherein the leakage fluid is mixed with the sealing fluid at the thrust compensation piston and wherein the leakage fluid is relatively hot steam and the sealing fluid is relatively cooler steam.

20. A method for discharging hot leakage fluid in a turbine, which leakage fluid flows through a radial gap between a thrust compensation piston of a rotor and a stationary turbine part, comprising:

mixing the hot leakage fluid with a cooler sealing fluid; and discharging the mixed fluid, wherein the sealing fluid is conveyed radially outward by a rotation of the rotor, via a delivery device arranged on the thrust compensation piston and wherein the leakage fluid is relatively hot steam and the sealing fluid is relatively cooler steam.

* * * * *